US011336066B2

(12) United States Patent
Shao

(10) Patent No.: US 11,336,066 B2
(45) Date of Patent: May 17, 2022

(54) SERIALLY-CONNECTABLE DEVICE FOR ELECTRICAL CABLE

(71) Applicant: BLOOMING INTERNATIONAL LIMITED, British West Indies (AI)

(72) Inventor: Shu-Fa Shao, Taipei (TW)

(73) Assignee: Blooming International Limited, British West Indies (AI)

( * ) Notice: Subject to any disclaimer, the term of this patent is extended or adjusted under 35 U.S.C. 154(b) by 0 days.

(21) Appl. No.: 16/573,890

(22) Filed: Sep. 17, 2019

(65) Prior Publication Data

US 2020/0403360 A1 Dec. 24, 2020

(30) Foreign Application Priority Data

Jun. 19, 2019 (CN) ..... 201910533343.7
Aug. 21, 2019 (CN) ..... 201910773566.0

(51) Int. Cl.
*H01R 31/06* (2006.01)
*F21V 21/005* (2006.01)
(Continued)

(52) U.S. Cl.
CPC ..... *H01R 31/06* (2013.01); *F21S 4/26* (2016.01); *F21V 15/01* (2013.01); *F21V 21/005* (2013.01);
(Continued)

(58) Field of Classification Search
CPC ..... H01R 31/06; H01R 31/065; H01R 12/75; H01R 13/6273; H01R 24/28; H01R 24/86;
(Continued)

(56) References Cited

U.S. PATENT DOCUMENTS 4,379,609 A * 4/1983 Hardesty ..... H01R 13/639 439/344
4,438,998 A * 3/1984 Myers ..... H01R 31/02 439/638
(Continued)

FOREIGN PATENT DOCUMENTS

CA 2 655 486 A1 9/2009
CN 200982547 Y 11/2007
(Continued)

OTHER PUBLICATIONS

U.S. Appl. No. 16/846,784, filed Apr. 13, 2020, Inventor Shu-Fa Shao.
(Continued)

*Primary Examiner* — Edwin A. Leon
*Assistant Examiner* — Milagros Jeancharles
(74) *Attorney, Agent, or Firm* — Christensen, Fonder, Dardi & Herbert PLLC

(57) ABSTRACT

A serially-connectable device includes a plug, an electrical cable, and a joining sleeve. The plug includes an insert portion and apertures are arranged in parallel to each other and formed through the insert portion. The electrical cable includes metal wires, such as wires of a light string. Ends of the wires respectively run through the apertures, and are folded back onto a surface of the insert portion to form exposed wire portions servicing as terminal pins. The joining sleeve includes two insert holes. Electrical conductors are disposed within the joining sleeve. Each electrical conductor extends from one of the two insert holes to the other insert hole. The insert portion is inserted into one of the two insert holes, to have the pins respectively contact the electrical conductors. Through the combination of the joining sleeve and the plug, two electrical cables can be quickly connected in a serial manner.

10 Claims, 10 Drawing Sheets

(51) Int. Cl.

| | |
|---|---|
| ***H01R 24/28*** | (2011.01) |
| ***H01R 12/75*** | (2011.01) |
| ***H01R 13/627*** | (2006.01) |
| ***F21S 4/26*** | (2016.01) |
| ***H01R 4/2406*** | (2018.01) |
| ***H05B 45/48*** | (2020.01) |
| ***F21V 15/01*** | (2006.01) |
| ***F21V 23/00*** | (2015.01) |
| ***H01R 13/05*** | (2006.01) |
| *H01R 105/00* | (2006.01) |
| *F21Y 103/10* | (2016.01) |
| *F21Y 115/10* | (2016.01) |

(52) U.S. Cl.

CPC ..... *F21V 23/001* (2013.01); *F21V 23/005* (2013.01); *H01R 4/2406* (2018.01); *H01R 12/75* (2013.01); *H01R 13/05* (2013.01); *H01R 13/6273* (2013.01); *H01R 13/6278* (2013.01); *H01R 24/28* (2013.01); *H01R 31/065* (2013.01); *H05B 45/48* (2020.01); *F21Y 2103/10* (2016.08); *F21Y 2115/10* (2016.08); *H01R 2105/00* (2013.01)

(58) Field of Classification Search

CPC ..... H01R 2105/00; H01R 13/5208; H01R 13/5804; H01R 13/506; H01R 13/62; H01R 13/627; H01R 13/6271; H01R 33/88; H01R 33/92; H01R 33/945; H01R 33/965; H01R 33/97; H01R 13/717; H01R 13/7172; H01R 25/14; F21S 2/00; F21S 4/00

See application file for complete search history.

(56) References Cited

U.S. PATENT DOCUMENTS 4,460,234 A * 7/1984 Bogese ..... H01R 31/06 439/188
4,593,966 A * 6/1986 Meyer ..... H01R 31/00 439/595
4,761,720 A 8/1988 Solow
4,812,956 A 3/1989 Chen
4,895,532 A * 1/1990 Bogese, II ..... H01R 31/06 439/507
4,908,743 A 3/1990 Miller
5,106,306 A * 4/1992 Ditzig ..... H01R 39/64 439/26
5,109,324 A 4/1992 Ahroni
5,150,964 A 9/1992 Tsui
5,245,519 A 9/1993 Openiano
5,454,737 A * 10/1995 Saba ..... H01R 13/743 439/350
5,645,342 A 7/1997 Chang
5,697,815 A * 12/1997 Drewnicki ..... H01R 31/02 439/638
5,747,940 A 5/1998 Openiano
5,834,901 A 11/1998 Shen
5,975,717 A 11/1999 Rahman
6,042,418 A 3/2000 Cummings
6,086,221 A 7/2000 Wu
6,086,222 A 7/2000 Juba
6,091,204 A 7/2000 Chen
6,113,432 A * 9/2000 Liao ..... H01R 13/514 439/638
6,146,207 A * 11/2000 Mulot ..... H01R 13/64 439/344
6,582,094 B2 6/2003 Liu
6,609,814 B2 8/2003 Ahroni
6,777,891 B2 8/2004 Lys et al.
6,914,194 B2 7/2005 Fan
7,048,550 B2 * 5/2006 Hyland ..... H01R 31/005 439/540.1
7,062,442 B2 6/2006 Sugar
7,088,904 B2 8/2006 Ryan, Jr.
7,160,140 B1 1/2007 Mrakovich et al.
7,235,815 B2 6/2007 Wang
7,250,730 B1 7/2007 Allen
7,253,566 B2 8/2007 Lys et al.
7,338,327 B2 * 3/2008 Sticker ..... H01R 24/64 439/638
7,481,555 B2 1/2009 Huang et al.
7,494,244 B1 2/2009 Van Diep
7,554,266 B1 6/2009 Chen
7,569,996 B2 8/2009 Holmes
7,784,961 B1 8/2010 Rawlings
7,905,753 B2 * 3/2011 Siev ..... H01R 31/06 439/638
7,926,978 B2 4/2011 Tsai
7,976,191 B2 7/2011 Gibboney
8,203,275 B2 6/2012 Ruxton
8,397,381 B2 3/2013 Tsai
8,454,186 B2 6/2013 Chen
8,454,187 B2 6/2013 Chen
8,469,734 B2 6/2013 Chen
8,469,750 B2 6/2013 Chen
8,480,278 B2 7/2013 Wasem
8,562,175 B2 10/2013 Chen
8,568,015 B2 10/2013 Chen
8,569,960 B2 10/2013 Chen
8,592,845 B2 11/2013 Chen
8,598,805 B2 12/2013 Tremblay
8,608,342 B2 12/2013 Chen
8,622,576 B2 1/2014 Zhan
8,641,229 B2 2/2014 Li
8,680,773 B2 3/2014 Hering et al.
8,876,321 B2 11/2014 Chen
8,974,072 B2 3/2015 Chen
9,044,056 B2 6/2015 Chen
9,055,777 B2 6/2015 Chen
9,066,617 B2 6/2015 Chen
9,157,587 B2 10/2015 Chen
9,166,323 B2 * 10/2015 Lampert ..... H01R 13/26
9,179,793 B2 11/2015 Chen
9,220,361 B1 12/2015 Chen
9,222,656 B2 12/2015 Chen
9,279,551 B2 3/2016 Vissenberg et al.
9,291,318 B1 3/2016 Benson
9,318,840 B2 * 4/2016 Siev ..... H01R 24/20
9,386,652 B1 7/2016 Lee
9,439,528 B2 9/2016 Chen
9,441,800 B1 9/2016 Chen
9,441,823 B1 9/2016 Chen
9,468,062 B2 10/2016 Rybicki
9,526,286 B2 12/2016 Chen
9,572,446 B2 2/2017 Chen
9,593,831 B2 3/2017 Chen
9,763,298 B2 3/2017 Yu
9,648,919 B2 5/2017 Chen
9,655,211 B2 5/2017 Altamura et al.
9,671,074 B2 6/2017 Chen
9,677,748 B1 6/2017 Chen
9,677,749 B2 6/2017 Chen
9,788,384 B1 10/2017 Harris
9,845,925 B2 12/2017 Chen
9,883,566 B1 1/2018 Chen
9,899,765 B2 * 2/2018 Wagner ..... H01R 13/5816
10,006,596 B2 6/2018 Yu et al.
10,103,493 B2 * 10/2018 Siev ..... H01R 13/6463
10,136,497 B2 11/2018 Harris
10,178,887 B1 1/2019 Chen
10,184,654 B1 1/2019 Chen
10,205,073 B2 2/2019 Altamura
10,288,235 B1 5/2019 Chen
10,288,236 B1 5/2019 Chen
10,578,260 B1 3/2020 Chen
10,624,166 B1 4/2020 Shao
10,697,598 B1 6/2020 Chen et al.
2002/0027778 A1 3/2002 Ko
2003/0063463 A1 4/2003 Sloan et al.

(56) References Cited

U.S. PATENT DOCUMENTS

| | | | | |
|---|---|---|---|---|
| 2004/0012950 | A1 | 1/2004 | Pan | |
| 2004/0080281 | A1 | 4/2004 | Pan | |
| 2004/0090770 | A1 | 5/2004 | Primeau | |
| 2004/0096596 | A1 | 5/2004 | Palmer, III et al. | |
| 2004/0165384 | A1 | 8/2004 | Allen | |
| 2004/0246718 | A1 | 12/2004 | Fan | |
| 2005/0174065 | A1 | 8/2005 | Janning | |
| 2006/0158878 | A1 | 7/2006 | Howell | |
| 2006/0221609 | A1 | 10/2006 | Ryan, Jr. | |
| 2007/0015396 | A1 | 1/2007 | Mrakovich et al. | |
| 2007/0177402 | A1 | 8/2007 | Wu | |
| 2007/0230174 | A1 | 10/2007 | Hicks | |
| 2007/0262725 | A1 | 11/2007 | Koren | |
| 2008/0049424 | A1 | 2/2008 | Wang | |
| 2008/0084695 | A1 | 4/2008 | Hsu | |
| 2008/0084702 | A1 | 4/2008 | Cheung | |
| 2008/0094828 | A1 | 4/2008 | Shao | |
| 2008/0218092 | A1 | 9/2008 | Chang et al. | |
| 2009/0154156 | A1 | 6/2009 | Lo et al. | |
| 2009/0278463 | A1 | 11/2009 | Tang | |
| 2009/0302771 | A1 | 12/2009 | Peng | |
| 2010/0001664 | A1 | 1/2010 | Shih | |
| 2010/0141161 | A1 | 6/2010 | Hering et al. | |
| 2010/0157598 | A1 | 6/2010 | Tsai | |
| 2010/0277084 | A1 | 11/2010 | Lee | |
| 2011/0062875 | A1 | 3/2011 | Altamura | |
| 2011/0074300 | A1 | 3/2011 | Hsu | |
| 2011/0148311 | A1 | 6/2011 | Neuman | |
| 2011/0210677 | A1 | 9/2011 | Hering et al. | |
| 2011/0228535 | A1 | 9/2011 | Shao | |
| 2011/0305022 | A1 | 12/2011 | Chen | |
| 2011/0316442 | A1 | 12/2011 | Sako et al. | |
| 2012/0007510 | A1 | 1/2012 | Horng | |
| 2012/0039070 | A1 | 2/2012 | Shen et al. | |
| 2012/0075863 | A1 | 3/2012 | Chen | |
| 2012/0275157 | A1 | 11/2012 | Hsu | |
| 2013/0078847 | A1 | 3/2013 | Chen | |
| 2013/0181232 | A1 | 7/2013 | Jeromerajan | |
| 2013/0249394 | A1 | 9/2013 | Fay | |
| 2013/0249417 | A1 | 9/2013 | Verlinden | |
| 2013/0301246 | A1 | 11/2013 | Chen | |
| 2014/0055439 | A1 | 2/2014 | Lee | |
| 2014/0179132 | A1* | 6/2014 | Byrne | H01R 25/162 439/92 |
| 2014/0268689 | A1 | 9/2014 | Chen | |
| 2014/0268818 | A1 | 9/2014 | Huang et al. | |
| 2014/0355277 | A1 | 12/2014 | Lin | |
| 2015/0008835 | A1 | 1/2015 | Sugiura et al. | |
| 2015/0029703 | A1 | 1/2015 | Chen | |
| 2015/0070878 | A1 | 3/2015 | Yu | |
| 2015/0117001 | A1 | 4/2015 | Fan | |
| 2016/0047516 | A1 | 2/2016 | Taylor | |
| 2016/0123566 | A1 | 5/2016 | Leung | |
| 2016/0183338 | A1 | 6/2016 | Loomis | |
| 2016/0186940 | A1 | 6/2016 | Del Castillo et al. | |
| 2016/0338171 | A1 | 11/2016 | Bhagat | |
| 2016/0341408 | A1 | 11/2016 | Altamura | |
| 2017/0023223 | A1 | 1/2017 | Tsai | |
| 2017/0038055 | A1 | 2/2017 | Daniels | |
| 2017/0055319 | A1 | 2/2017 | Rogers | |
| 2017/0108185 | A1 | 4/2017 | He | |
| 2017/0295622 | A1 | 10/2017 | Harris | |
| 2017/0328527 | A1 | 11/2017 | Yang et al. | |
| 2017/0343170 | A1 | 11/2017 | Yu et al. | |
| 2018/0020519 | A1 | 1/2018 | Harris | |
| 2018/0020520 | A1 | 1/2018 | Harris | |
| 2018/0058648 | A1 | 3/2018 | Fang | |
| 2018/0073708 | A1 | 3/2018 | Avery et al. | |
| 2018/0110101 | A1 | 4/2018 | Kottritsch | |
| 2018/0172225 | A1 | 6/2018 | Zhao | |
| 2018/0172226 | A1 | 6/2018 | Zhao | |
| 2018/0231226 | A1 | 8/2018 | Koo | |
| 2018/0299084 | A1 | 10/2018 | Chien | |
| 2019/0053348 | A1 | 2/2019 | Harris | |
| 2019/0081436 | A1* | 3/2019 | Onodi | H01R 13/5219 |
| 2019/0234597 | A1 | 8/2019 | Zhu | |
| 2019/0277458 | A1 | 9/2019 | Shao | |
| 2019/0335559 | A1 | 10/2019 | Shao | |
| 2020/0136363 | A1* | 4/2020 | Seo | E04F 17/08 |
| 2020/0236746 | A1 | 7/2020 | Shao | |
| 2020/0400278 | A1* | 12/2020 | Shao | H01R 24/28 |

FOREIGN PATENT DOCUMENTS

| | | | |
|---|---|---|---|
| CN | 201121811 | Y | 9/2008 |
| CN | 201897194 | U | 7/2011 |
| CN | 201898147 | U | 7/2011 |
| CN | 201966240 | U | 9/2011 |
| CN | 202613183 | U | 12/2012 |
| CN | 203703878 | U | 7/2014 |
| DE | 3240446 | A1 | 7/1983 |
| EP | 1 172 602 | A1 | 1/2002 |
| GB | 2 454 546 | A | 5/2009 |

OTHER PUBLICATIONS

U.S. Appl. No. 16/573,880, filed Sep. 17, 2019, Inventor Shu Fa Shao.

U.S. Appl. No. 16/298,935, filed Mar. 11, 2019, Inventor Shu Fa Shao.

U.S. Appl. No. 16/219,657, filed Dec. 13, 2018, Inventor Johnny Chen.

* cited by examiner

SERIALLY-CONNECTABLE DEVICE FOR ELECTRICAL CABLE

RELATED APPLICATIONS

The present application claims priority to Chinese Patent Application No. 201910533343.7, filed on Jun. 19, 2019 and Chinese Patent Application No. 201910773566.0, filed Aug. 21, 2019, which said applications are incorporated by reference in their entirety herein.

FIELD OF THE INVENTION

This disclosure relates to serial connection of two electrical cables, in particular, to a serially-connectable device for electrical cables.

BACKGROUND OF THE INVENTION

A light string includes a plurality of light sources directly soldered onto the power wire at intervals, so as to form a string-shaped illumination device without a lamp holder, as known in the art. To small-sized light sources, such as small bulbs, light emitting diodes, light string are a common arrangement of the light sources. A light string is as flexible as the power wire is, such that the string light is easily arranged in any configuration to comply with requirements for special illumination or decoration.

Generally, a length of a light string is fixed. If it is required to elongate the length of the light string, light strings have to be soldered together according to the circuit design of the light string. The soldering process is difficult to perform on a light string with thin power wires, and soldering defects usually occur.

SUMMARY

In view of the above problems, this disclosure provides a serially-connectable device to solve the above-mentioned problem.

This disclosure provides a serially-connectable device, including a plug, an electrical cable, and a fixing, latching, attaching or joining sleeve. The plug includes an insert portion and a plurality of apertures, and the apertures are arranged in parallel to each other and formed through the insert portion. The electrical cable includes a plurality of metal wires. Tips of the metal wires respectively run through the apertures and are folded back onto a surface of the insert portion to form a plurality of pins or conductive terminal portions. In an embodiment, the joining sleeve is a hollow structure with two insert holes formed on two ends of the joining sleeve. A plurality of electrical conductors are disposed within the joining sleeve, each of the electrical conductors extends from one of the two insert holes to the other insert hole, and the insert portion is inserted into one of the two insert holes, to have the wire conductive portions or "pins" respectively contact the electrical conductors in the sleeve.

In at least one embodiment of this disclosure, each of the metal wires is wrapped by an electrical insulation layer, and the electrical insulation layer on the tip of each of the metal wires is removed.

In at least one embodiment of this disclosure, the plug includes a latch member, the fixing sleeve includes at least one latch hole corresponding to the latch member, and the latch member is engaged into the latch hole.

In at least one embodiment of this disclosure, the joining sleeve includes an upper case body and a lower case body separable from each other.

In at least one embodiment of this disclosure, a plurality of clamping grooves are arranged in the joining sleeve, the clamping grooves are on the lower case body, each of the clamping grooves extends from one of the two insert holes to the other insert hole, and the electrical conductors are metal strips respectively fixed in the clamping grooves.

In at least one embodiment of this disclosure, each of the electrical conductors is a sheet metal spring with two ends being elastic deformable, the electrical conductors are fixed to the fixing sleeve in parallel to each other, and in an embodiment, each of the electrical conductors extends from one of the two insert holes to the other insert hole.

In at least one embodiment of this disclosure, the fixing sleeve further includes a circuit board, the electrical conductors are printed wires or conductors on the circuit board, and the printed conductors extend from one end to the other end of the circuit board in parallel to each other; the circuit board is fixed in the fixing sleeve to have two ends of the circuit board be arranged corresponding to the two insert holes.

In at least one embodiment of this disclosure, the fixing sleeve system further comprises at least one electronic component disposed within the fixing sleeve and connected to at least one of the electrical conductors.

Through the serially-connectable device of this disclosure, electrical cables can be quickly connected in series without a soldering process. In particular the serially-connectable device of this disclosure can be utilized to connect light strings, so as to quickly elongate the length of a light string. Through the combination of the fixing sleeve and the plug, mechanical and electrical connections between two electrical cables are achieved, and the fixing sleeve further provides protection by wrapping, so as to accomplish purposes of electrical insulation and waterproof.

BRIEF DESCRIPTION OF THE DRAWINGS

The present invention will become more fully understood from the detailed description given herein below for illustration only, and thus does not limit the present invention, wherein.

DETAILED DESCRIPTION

Figure 1:
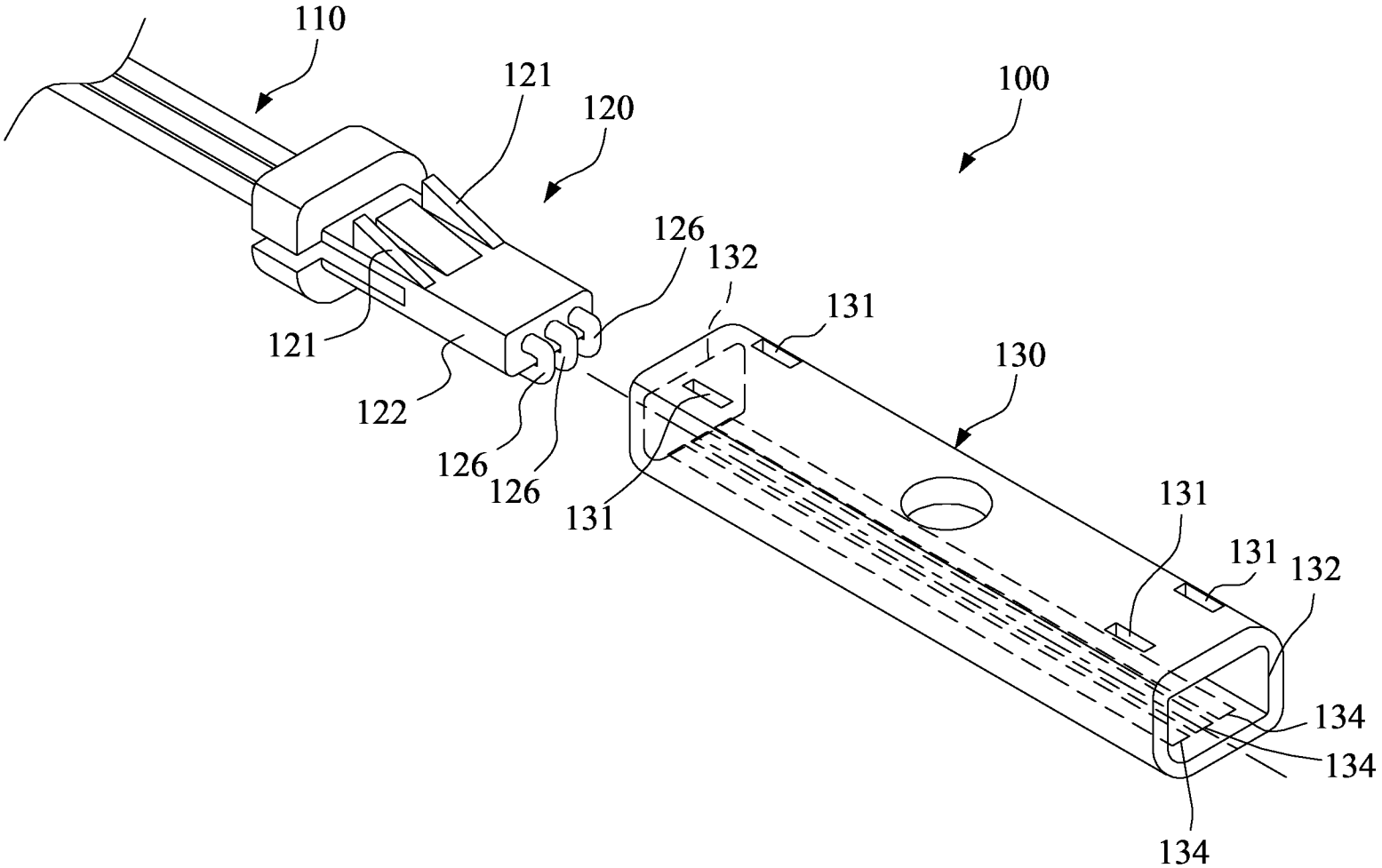
FIG. 1 is an exploded view of an electrical cable, a plug, and a joining sleeve according to a first embodiment of this disclosure.
Figure 2:
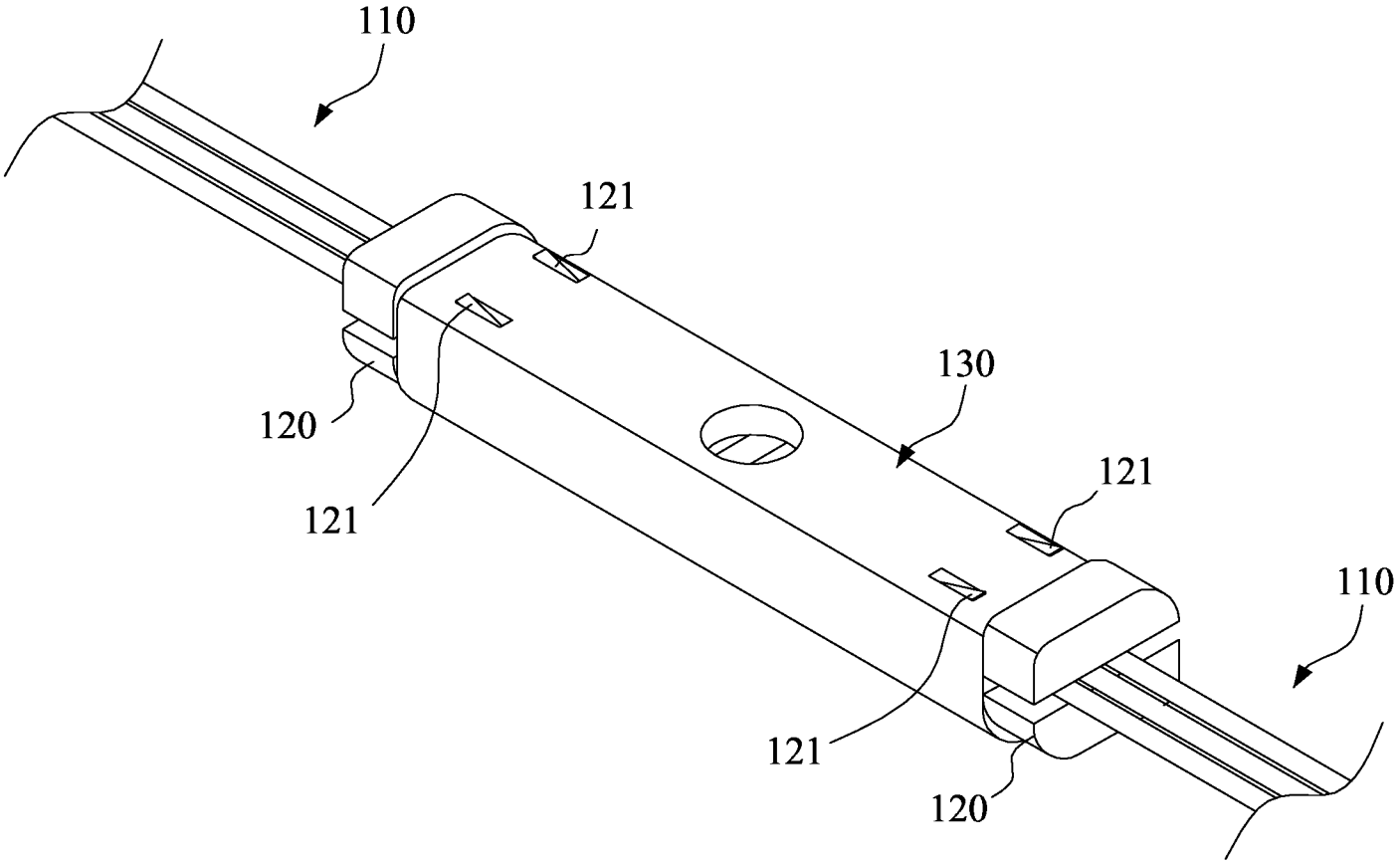
FIG. 2 is a perspective view of the electrical cable, the plug, and the joining sleeve according to a first embodiment of this disclosure.

As shown in FIG. 1 and FIG. 2, a serially-connectable device 100 according to a first embodiment of this disclosure comprises two electrical cables 110, two plugs 120 and a joining sleeve 130. To simplify the drawings, only one electrical cable 110 and one plug 120 are shown in FIG. 1. Two plugs 120 are identical male connectors. And the joining sleeve 130 is a female socket, including two insert holes 132 on two ends, i.e., a first insert hole 132 at a first end and a second insert hole 132 at a second end. Each insert hole 132 is configured to receive one plug 120, so as to electrically connect two plugs 120 via the joining sleeve 130.

Figure 3:
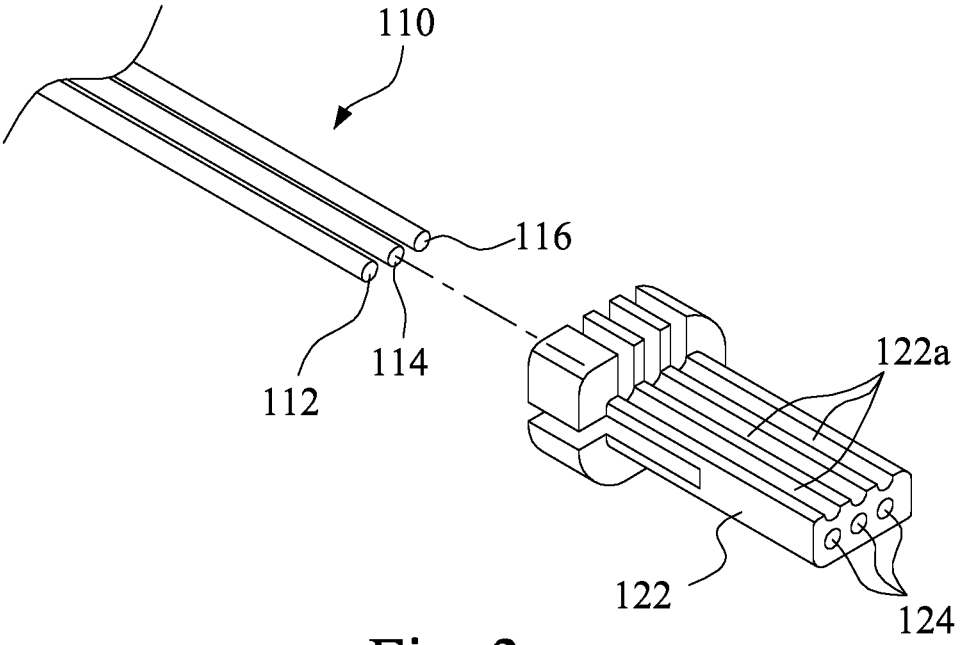
FIG. 3 is an exploded view of the electrical cable and the plug according to the first embodiment of this disclosure.
Figure 4:
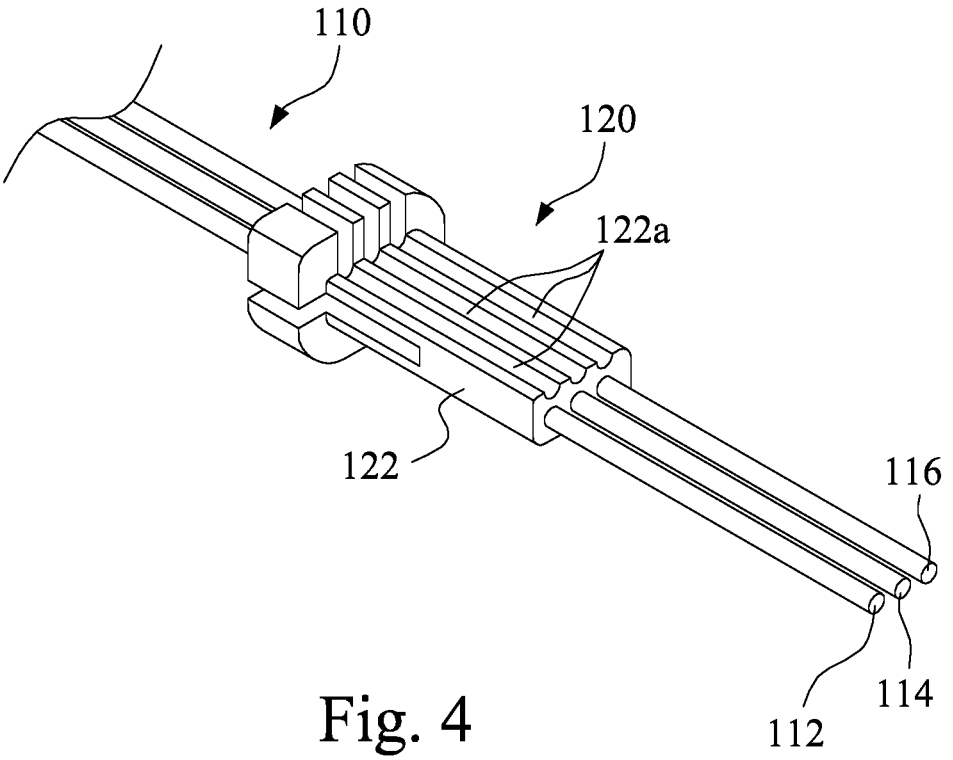
FIG. 4 and FIG. 5 are perspective views of the electrical cable and the plug of this disclosure.
Figure 5:
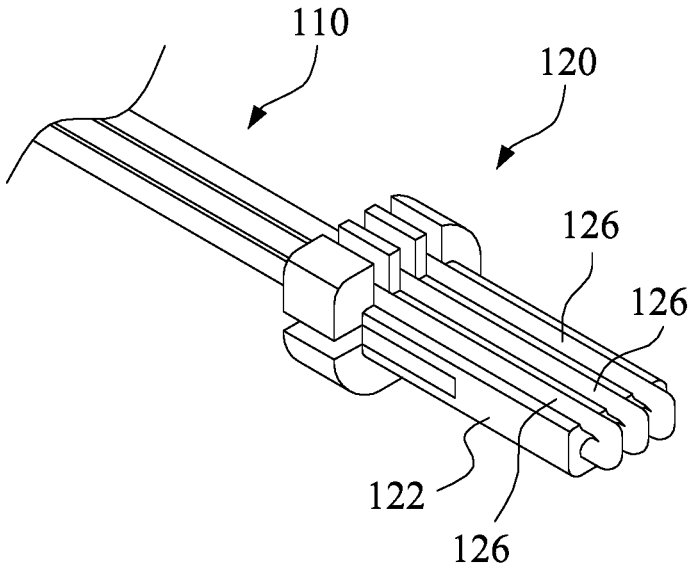

As shown in FIG. 3, FIG. 4, and FIG. 5, the electrical cable 110 includes a plurality of conductive metal wires 112, 114, 116 arranged in parallel. Each of the metal wires 112, 114, 116 is wrapped by an electrical insulation layer, and the electrical insulation layer can be a coating layer of insulating paint or a coating layer of plastic, such as polyvinyl chloride (PVC). When the electrical insulation layer is a coating layer of plastic, the plastic coating layers of all the metal wires 112, 114, 116 can be formed monolithically and electrically insulate the three metal wires 112, 114, 116 to form a plastic cover cable. Moreover, the electrical insulation layer on the tip of each of the metal wires 112, 114, 116 is removed.

As shown in FIG. 3, FIG. 4, and FIG. 5, the plug includes an insert portion 122 and a plurality of apertures 124. The apertures 124 are arranged in parallel to each other and formed through the insert portion 122. The number of the apertures 124, in an embodiment, is equal to the number of the metal wires 112,114, 116. For example, when three metal wires 112,114, 116 are used, three apertures 124 are required. Ends or tips of the metal wires 112, 114, 116 respectively run through the apertures 124 and are back folded on a surface of the insert portion 122 to form a plurality of pins 126 that are formed by the bare conductive portions of wires 112, 114 and 116. It will be understood that although the term "pins 126" refers to those bare, end conductive portions of wires 112, 114, and 116. Therefore, soldering process for soldering the tips of the metal wires 112, 114, 116 onto pins is not required. A plurality of positional grooves 122*a* are arranged on the surface of the insert portion 122, so as to position pins or conductive portions 126 formed by folding back the stripped end portions of metal wires 112, 114, 116. Three metal wires 112,114,116 in the drawings are for illustration purposes and are not meant to limit the number of the metal wires 112, 114, 116 or the number of the apertures 124. In an embodiment, the number of wires and corresponding apertures may be fewer or more than three, such as two or four. Meanwhile, the number or quantity of the apertures 124 can be more than the number of the metal wires 112, 114, 116. In such an instance, some apertures 124 will be left unused.

As shown in FIG. 1 and FIG. 2, in an embodiment, the joining sleeve 130 is a hollow structure with two insert holes 132 formed on two ends of the joining sleeve 130. A plurality of electrical conductors 134 are disposed within the joining sleeve 130 and each of electrical conductors 134 extends from one of the two insert holes 132 to the other insert hole 132. The configuration of each electrical conductor 134 is not limited to the configuration shown in the drawings. Any configuration that extends from one of the two insert holes 132 to the other insert hole 132 is acceptable as long as the electrical conductors 134 are spaced and insulated from each other. Furthermore, the number of the electrical conductors 134 equals to the number of the pins 126, that is, the number of the electrical conductors 134 equals the number of the metal wires 112, 114, 116. In an embodiment, each electrical conductor 134 is continuous from one hole 132 to another hole 132. In other embodiments, an electrical conductor 134 may be interrupted, or non-continuous.

As shown in FIG. 2, the insert portion 122 of the plug 120 is configured to be inserted into the insert hole 132 of the joining sleeve 130, to have the pins 126 contact the electrical conductors 134. Therefore, mechanical and electrical connections between two electrical cables 120 are accomplished by the combination of the joining sleeve 130 and the two plugs 120. At this time, the pins 126 as well as the back-folded parts of the metal wires 112, 114, 116 are clamped by the joining sleeve 130, which has an anti-tensile strength higher than the anti-tensile strength of soldering. Two plugs 120 are wrapped by the joining sleeve 130, such that the purposes of electrical insulation and waterproof are simultaneously accomplished.

In at least one embodiment, each of the plugs 120 includes a latch member 121. The joining sleeve 130 includes latch holes 131 corresponding to the latch members 121. When the insert portions 122 of the two plugs 120 respectively insert into the two insert holes 132 of the joining sleeve 130, the latches 121 respectively engage into one of the latch holes 131, such that the two plugs 120 are securely fixed to the joining sleeve 130.

As described above, the configuration of each electrical conductor 134 is not limited. The following embodiments are to illustrate different configurations of the electrical conductors 134.

Figure 6:
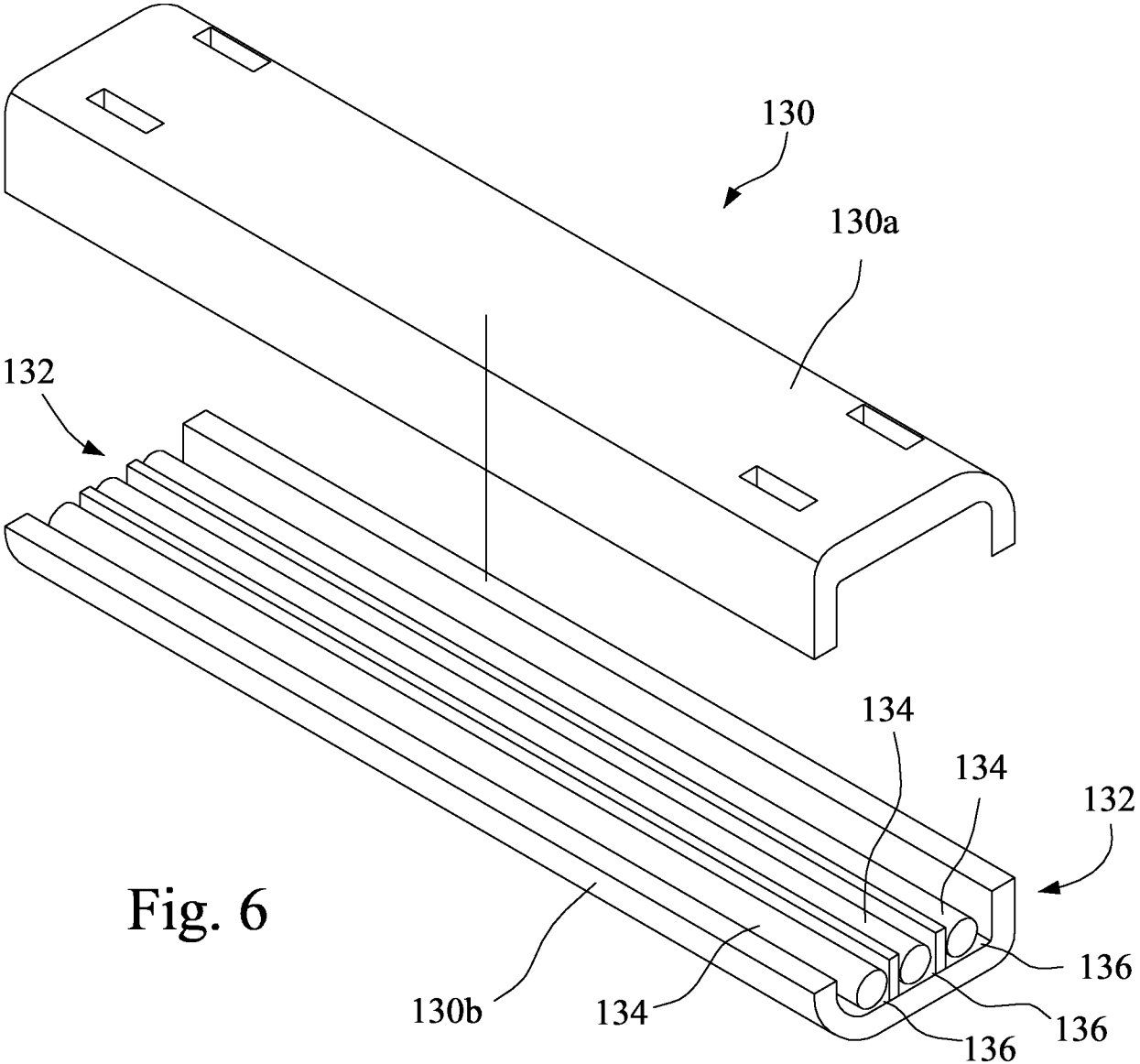
FIG. 6 is an exploded view of a joining sleeve according to a second embodiment of this disclosure.

As shown in FIG. 6, a joining sleeve 130 according to a second embodiment of this disclosure is adopted to the serially-connectable device 100 of the first embodiment.

As shown in FIG. 6, the joining sleeve 130 includes an upper case body 130*a* and a lower case body 130*b* separable from each other, which is convenient for the installation of the electrical conductors 134. A plurality of clamping grooves 136 are arranged in the joining sleeve 130, the clamping grooves 130 are on the lower case body 130*b*, each of the clamping grooves 136 extends from one of the two insert holes 132 to the other insert hole 132. In an embodiment, the electrical conductors 134 are metal strips. The cross-section of the electrical conductor 134 can be circular, elliptical, rectangular, etc., as long as the metal strip can be put into the clamping groove 134. The method to fix the metal strip can be, but not limited to, engaging blocks, adhesive, etc., as long as the metal strip can be fixed in the clamping groove 134. In practice, a metal strip can be a short piece of the electrical cable 110 without the electrical insulation layer, that is, the metal strip can be a piece of metal wire 112, 114, 116 cut to a proper length.

Figure 7:
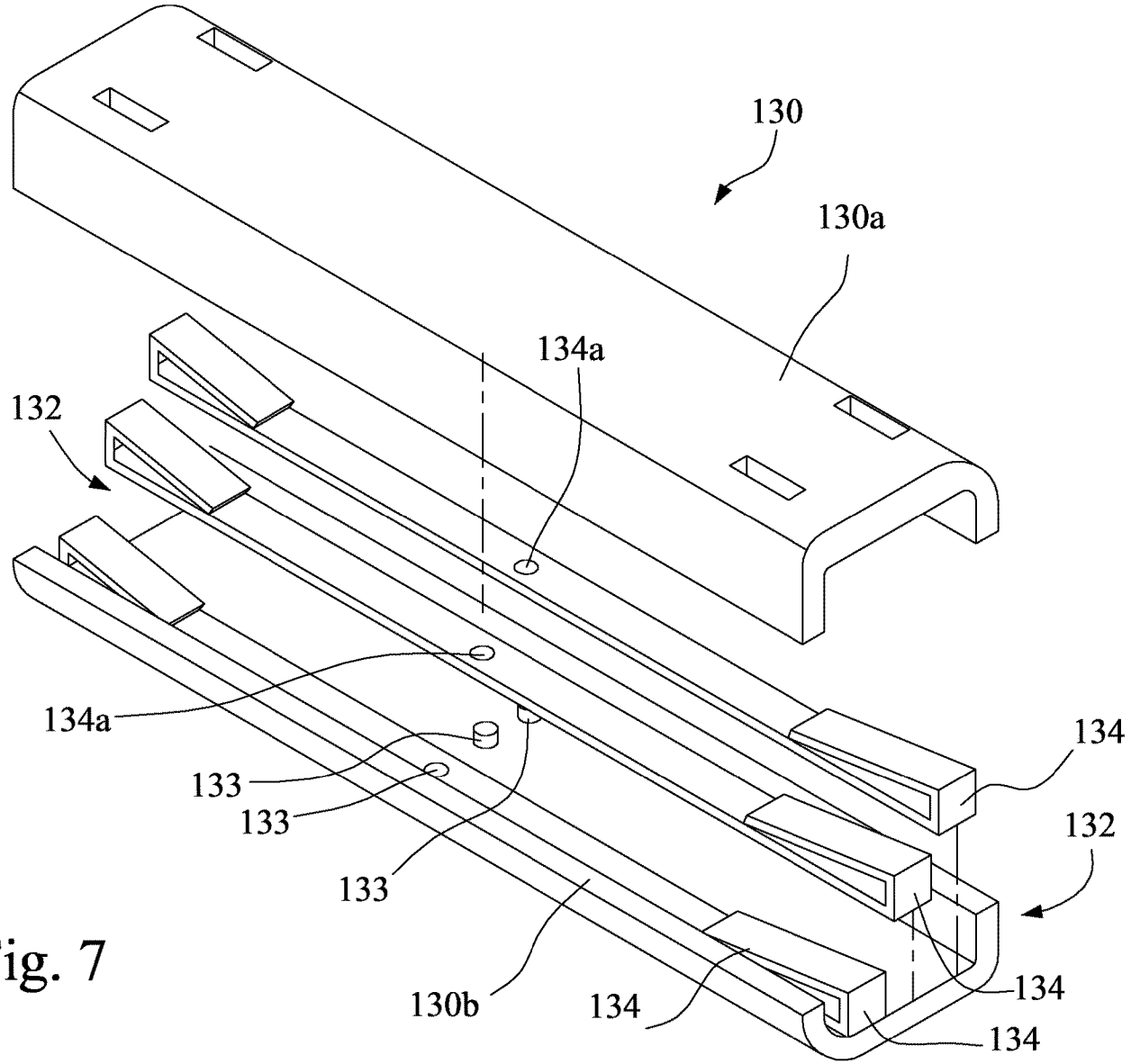
FIG. 7 is an exploded view of a joining sleeve according to a third embodiment of this disclosure.

As shown in FIG. 7, a joining sleeve 130 according to a third embodiment of this disclosure is adapted to the serially-connectable device 100 of the first embodiment. The joining sleeve 130 of the third embodiment also includes an upper case body 130*a* and a lower case body 130*b* separable from each other, which is convenient for the installation of the electrical conductors 134. Each of the electrical conductors 134 is a sheet-metal spring with two ends being elastic deformable, so as to contact pins 126. The sheet-metal springs are fixed in the joining sleeve 130 in parallel to each other and extend, in an embodiment, from one of the two insert holes 132 to the other insert hole 132. In an embodiment, the springs extend less than the entire length of the joining sleeve. Such a configuration may prevent exposure of live parts. The method to fix the sheet metal spring can be, but not limited to, engaging blocks, adhesive, etc., as long as the sheet metal spring can be fixed to the joining sleeve 130. As shown in FIG. 7, joining posts 133 are disposed on the lower case body 130*b*, the joining posts 133 are used to respectively run through joining holes 134*a* of the sheet metal springs (electrical conductors 134), so as to fix the sheet metal springs (electrical conductors 134) on the lower case body 130*b*. When the upper case body 130*a* is combined with the lower case body 130*b*, the sheet metal springs (electrical conductors 134) are fixed within the joining sleeve 130.

Figure 8:
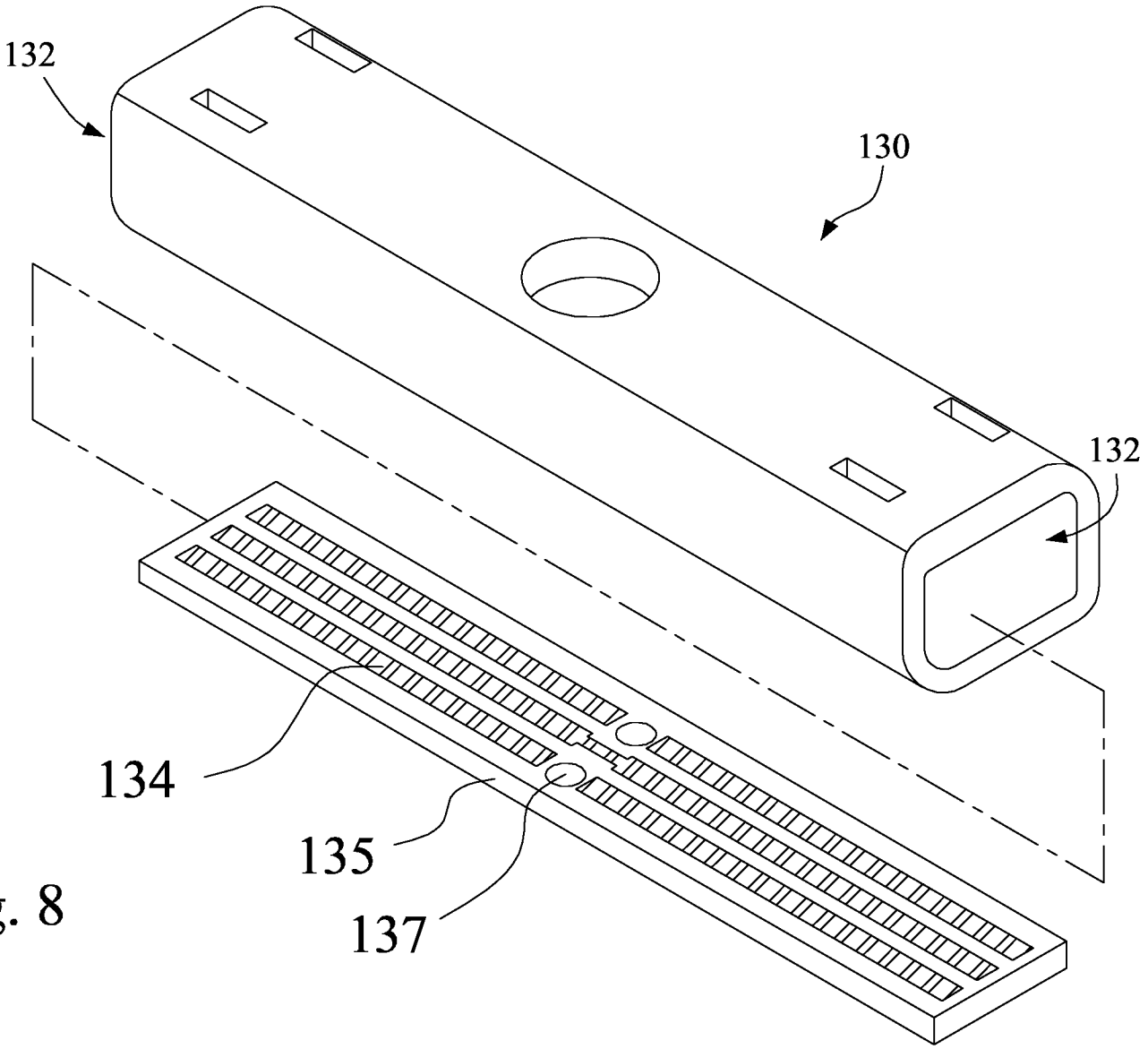
FIG. 8 is an exploded view of a joining sleeve according to a fourth embodiment of this disclosure.

As shown in FIG. 8, a joining sleeve 130 according to a fourth embodiment of this disclosure is adopted to the serially-connectable device 100 of the first embodiment. As shown in FIG. 8, the joining sleeve 130 further includes a circuit board 135, the electrical conductors 134 are printed wires on the circuit board 135, and the printed wires extend from one end to the other end of the circuit board 135 in parallel to each other; the circuit board 135 is fixed in the joining sleeve 130, to have two ends of the circuit board 135 be arranged corresponding to the two insert holes 132 and extend from one of the two insert holes 132 to the other insert hole 132. The printed wires are used to contact pins 126 of the plugs 120, so as to electrically connect two electrical cables 110.

As shown in FIG. 8, in addition to the electrical conductors 134 for connecting electrical cable 110, electronic components 137 such as resistors, transistors, etc., can be disposed within the joining sleeve 130, the electronic components 137 are connected to at least one of the electrical conductors 134, so as to adjust the electrical connection status between the two plugs 120.

Figure 9:
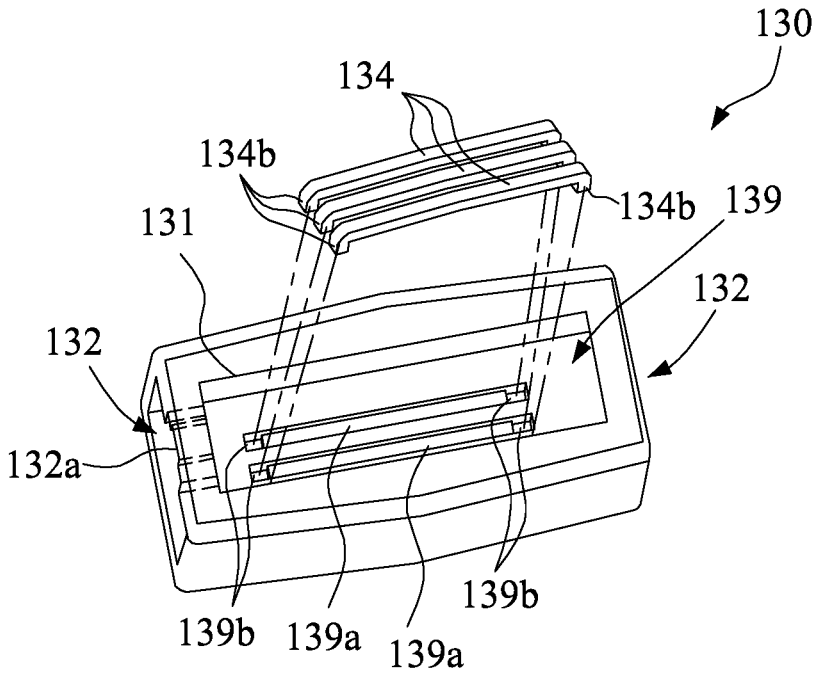
FIG. 9 is an exploded view of a joining sleeve according to a fifth embodiment of this disclosure.
Figure 10:
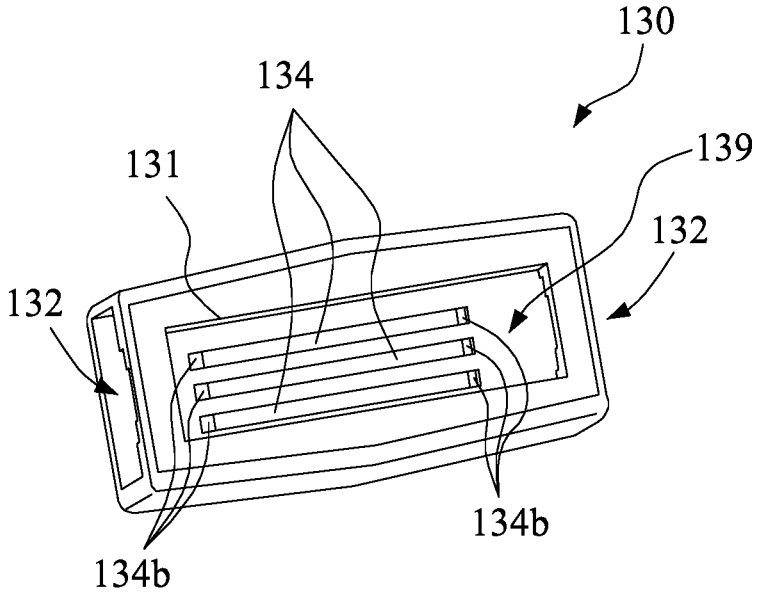
FIG. 10 is a perspective view of a joining sleeve according to the fifth embodiment of this disclosure.

As shown in FIG. 9 and FIG. 10, a joining sleeve 130 according to a fifth embodiment of this disclosure is adopted to a serially-connectable device 100.

As shown in FIG. 9 and FIG. 10, the joining sleeve 130 is a hollow structure with two insert holes 132 formed on two ends of the joining sleeve 130. The joining sleeve 130 includes a window 131 exposing an inner wall surface 139 of the joining sleeve 130. A plurality of embedding grooves 139*a* are formed on the inner wall surface 139, the embedding grooves 139*a* are arranged in parallel to each other, and extend from one of the two insert holes 132 to the other insert hole 132. Meanwhile, two ends of each of the embedding grooves 139*a* are respectively equipped with an embedding hole 139*b*. The length of each electrical conductors 134 approximately equals or is slightly larger than the length of each of the embedding grooves 139*a*. Meanwhile, two ends of each of the electrical conductors 134 are respectively equipped with bending portion 134*b*. The electrical conductors 134 are respectively embedded into the embedding grooves 139*a*, and bending portions 134*b* are respectively embedded into the embedding holes 139*b*, so as to fixed the electrical conductors 134 on the inner wall surface 139 and slightly protrude onto the inner wall surface 139. When the length of each electrical conductor 134 is larger than the length of each embedding groove 139*a*, the middle section of the electrical conductor 134 is bent and protrudes upward to form an elastic structure on the inner wall surface 139.

Figure 11:
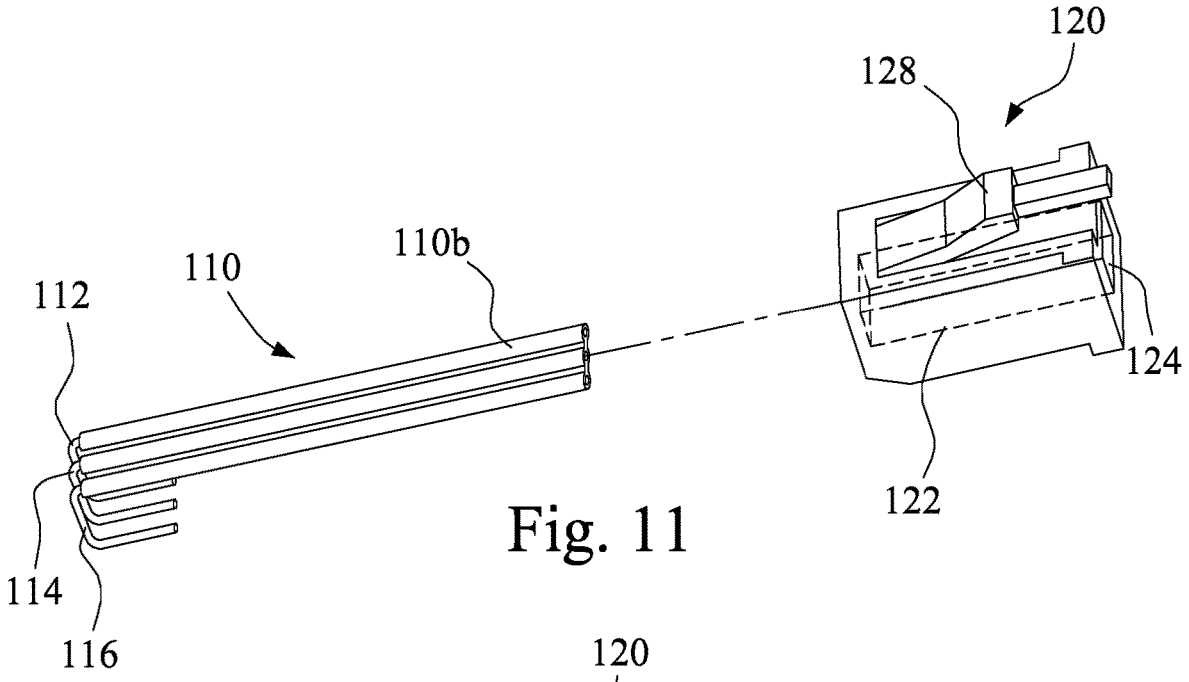
FIG. 11 is an exploded view of an electrical cable and a plug according to the fifth embodiment of this disclosure.
Figure 12:
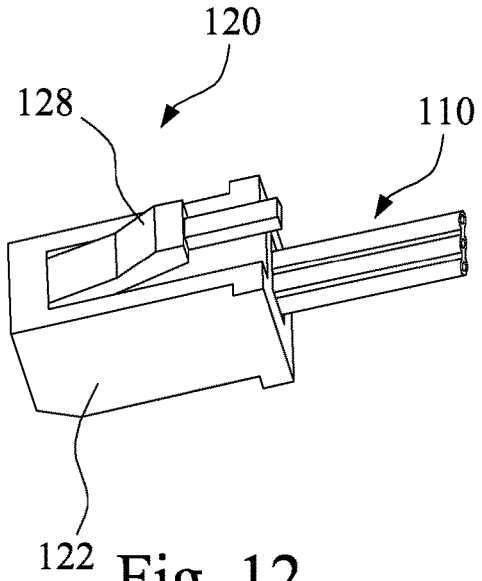
FIG. 12 and FIG. 13 are perspective views of the electrical cable and the plug according to the fifth embodiment of this disclosure.
Figure 13:
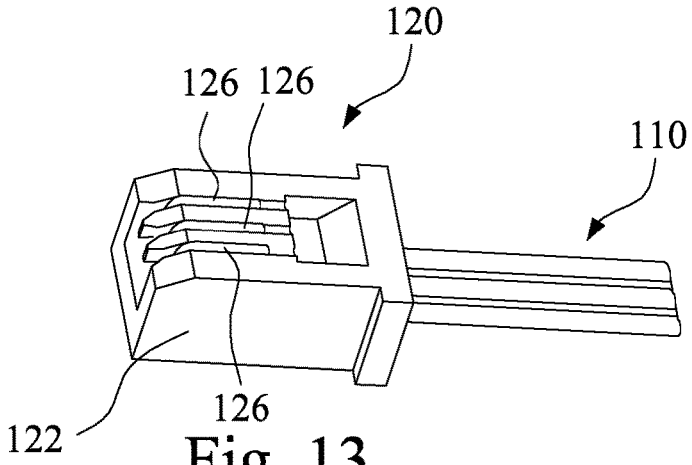

Referring to FIG. 11, FIG. 12, and FIG. 13, the fifth embodiment further discloses a plug 120. The plug 120 includes an insert portion 122 and a plurality of apertures 124. Different from the aforementioned embodiments, the plug 120 includes only one large aperture 124, and this large aperture 124 can simultaneously receive a plurality of metal wires 112, 114, 116. At this time, it necessary to wrap the part of the metal wires 112, 114, 116 inside the apertures with electrical insulation layers, so as to prevent short-circuiting from occurring in the aperture 124. The electrical insulation layer on the ends and tip of each of the metal wires 112, 114, 116 in this embodiment is still required to be removed, and the ends of the metal wires 112, 114, 116 are folded back onto a surface of the insert portion 122.

As shown in FIG. 9, FIG. 10, FIG. 11, and FIG. 12, an elastic latch 128 is disposed on the insert portion 122, and a guiding groove 132*a* is formed on an edge of each of the insert holes 132 and extends toward the window 131.

Figure 14:
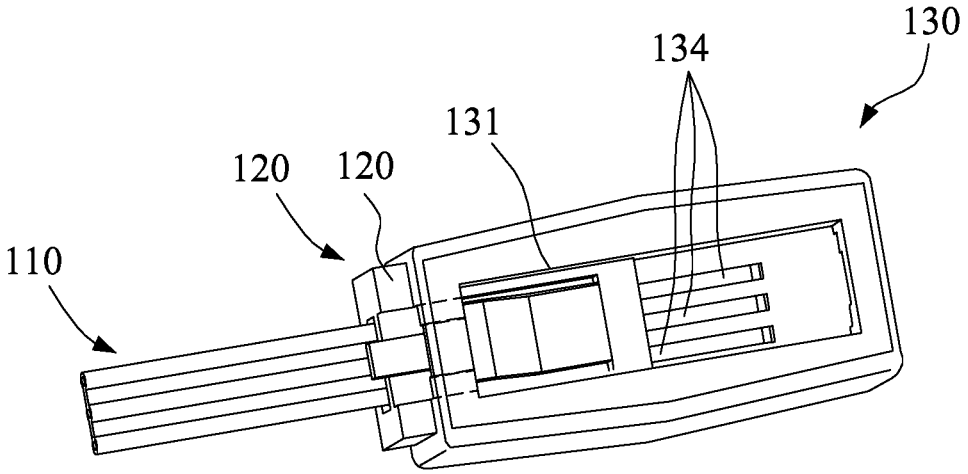
FIG. 14 is a perspective view of the electrical cable, the plug, and the joining sleeve according to the fifth embodiment of this disclosure.

As shown in FIG. 14, when the insert portion 122 inserts into the insert hole 132, the guiding groove 132*a* guides the elastic latch 128 moving toward the window 131, and latches an edge of the window 131, so as to fix the plug 120 to the joining sleeve 130, and have the pins 126 contact the electrical conductors 134. When removing the plug 120, pressing the part of the elastic latch 128 outside the insert hole 132, the elastic latch 128 releases the plug 120, and the plug 120 can be pulled away.

Figure 15:
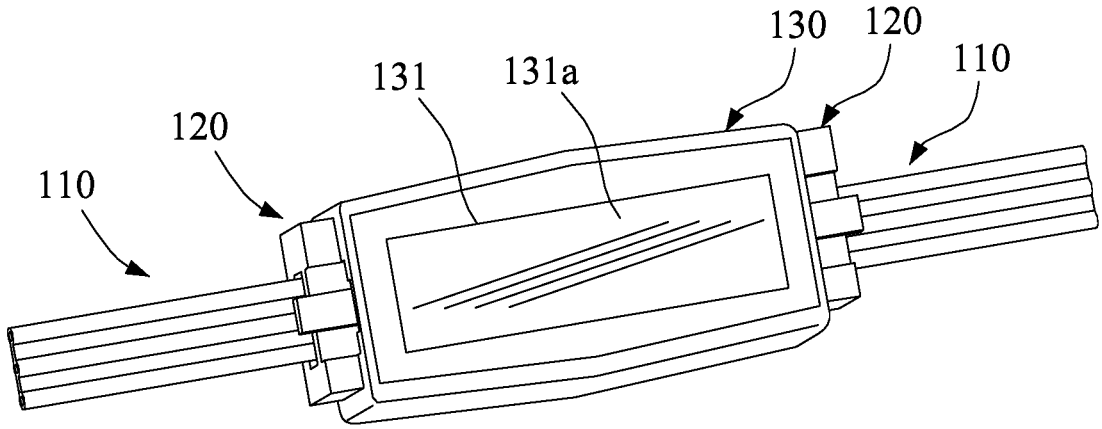
FIG. 15 is another perspective view of the electrical cable, the plug, and the joining sleeve according to the fifth embodiment.

As shown in FIG. 15, the window 131 is provided for the installation of the electrical conductors 134. After the electrical conductors 134 are installed, a sealing member 131*a* is used to seal the window 131, such that the electrical conductors 134 are not exposed via the window 131. If the plugs 120 are not required to be removed, the sealing member 131*a* can be adhesive, such as UV-curable adhesive, which can fully seal the joining sleeve 130, to enhance waterproof performance.

According to embodiments of this disclosure, electrical cables 110 can be quickly connected in series without a soldering process. In particular the serially-connectable device of this disclosure can be utilized to connect light strings, so as to quickly elongate the length of a light string. Through the combination of the joining sleeve 130 and the plug 120, mechanical and electrical connections between two electrical cables 110 are achieved, and the joining sleeve 130 further provides protection by wrapping, so as to accomplish purposes of electrical insulation and waterproof.

What is claimed is:

1. A serially-connectable light-string device, comprising:

a plug, including an insert portion and defining a plurality of apertures, the apertures being formed through the insert portion;

a plurality of conductive light-string wires of the light-string device, wherein ends of the conductive light-string wires are respectively inserted into the apertures, and are folded back onto a surface of the insert portion to form a plurality of exposed conductive portions of the light-string wires; and a joining sleeve, defining two insert holes; wherein a plurality of electrical conductors are disposed within the joining sleeve, each of the electrical conductors extends in a direction from one of the two insert holes to the other insert hole, and the insert portion is inserted into one of the two insert holes, to have the exposed conductive portions of the light-string wires respectively directly contact the plurality of electrical conductors.

2. The serially-connectable light-string device as claimed in claim 1, wherein each of the conductive light-string wires is wrapped by an electrical insulation layer and the electrical insulation layer on the ends of each of the conductive light-string wires is removed.

3. The serially-connectable light-string device as claimed in claim 1, wherein the plug includes a latch member, the joining sleeve defines at least one latch hole corresponding to the latch member, and the latch member is inserted into the latch hole.

4. The serially-connectable light-string device as claimed in claim 1, wherein the joining sleeve includes an upper case body and a lower case body separable from each other.

5. The serially-connectable light-string device as claimed in claim 4, wherein a plurality of clamping grooves are arranged in the joining sleeve, the clamping grooves are on the lower case body, and the electrical conductors are metal strips respectively fixed in the clamping grooves.

6. The serially-connectable light-string device as claimed in claim 1, wherein each of the electrical conductors is a sheet-metal spring with two ends being elastically deformable, the electrical conductors are affixed to the joining sleeve in parallel to each other, and each of the electrical conductors extends in a direction from one of the two insert holes to the other insert hole.

7. The serially-connectable light-string device as claimed in claim 1, wherein the joining sleeve further includes a circuit board, the electrical conductors are printed conductors on the circuit board, and the printed conductors extend from one end to the other end of the circuit board in parallel to each other; the circuit board is fixed in the joining sleeve to have two ends of the circuit board be arranged corresponding to the two insert holes.

8. The serially-connectable light-string device as claimed in claim 1, further comprising at least one electronic component disposed within the joining sleeve and connected to at least one of the electrical conductors.

9. The serially-connectable light-string device as claimed in claim 1, wherein the joining sleeve includes a window exposing an inner wall surface of the joining sleeve, a plurality of embedding grooves are formed on the inner wall surface, the embedding grooves are arranged in parallel to each other and extend in a direction from one of the two insert holes to the other insert hole, and the electrical conductors are respectively embedded into the embedding grooves.

10. The serially-connectable light-string device as claimed in claim 9, wherein an elastic latch is disposed on the insert portion, a guiding groove is formed on an edge of each of the insert holes and extends toward the window, and the guiding groove is configured to guide the elastic latch toward the window to latch to an edge of the window.

* * * * *